US009315906B2

(12) United States Patent
Ishikawa et al.

(10) Patent No.: US 9,315,906 B2
(45) Date of Patent: Apr. 19, 2016

(54) ANODE, CORROSION-PROTECTING STRUCTURE FOR CONCRETE CONSTRUCTIONS USING THIS, AND CORROSION PROTECTION METHOD

(75) Inventors: Yasuto Ishikawa, Tokyo (JP); Shirou Yamamoto, Tokyo (JP); Hirokazu Iiduka, Tokyo (JP); Jun Suzuki, Tokyo (JP); Tsutomu Nakamura, Tokyo (JP); Norimasa Mimura, Tokyo (JP); Yuichi Futaki, Tokyo (JP)

(73) Assignee: Fujimori Kogyo Co., Ltd., Tokyo (JP)

( * ) Notice: Subject to any disclaimer, the term of this patent is extended or adjusted under 35 U.S.C. 154(b) by 13 days.

(21) Appl. No.: 14/240,570

(22) PCT Filed: Aug. 24, 2012

(86) PCT No.: PCT/JP2012/071379

§ 371 (c)(1),
(2), (4) Date: Feb. 24, 2014

(87) PCT Pub. No.: WO2013/031663

PCT Pub. Date: Mar. 7, 2013

(65) Prior Publication Data

US 2014/0224670 A1 Aug. 14, 2014

(30) Foreign Application Priority Data

Aug. 26, 2011 (JP) ..... 2011-185123
Feb. 15, 2012 (JP) ..... 2012-030716

(51) Int. Cl.

| | |
|---|---|
| ***C23F 13/00*** | (2006.01) |
| ***C23F 13/06*** | (2006.01) |
| ***C23F 13/16*** | (2006.01) |
| ***E04C 5/01*** | (2006.01) |

(52) U.S. Cl.

CPC ..... *C23F 13/005* (2013.01); *C23F 13/06* (2013.01); *C23F 13/16* (2013.01); *E04C 5/015* (2013.01); *C23F 2201/02* (2013.01); *C23F 2213/22* (2013.01); *C23F 2213/30* (2013.01)

(58) Field of Classification Search

CPC ..... C23F 13/02; C23F 13/06; C23F 13/08; C23F 13/10; C23F 13/16; C23F 13/18; C23F 2201/02; C23F 2213/22

USPC ..... 204/196.01, 196.1, 196.17, 196.18, 204/196.19, 196.2, 196.21, 196.3, 196.33, 204/196.36, 196.38

See application file for complete search history.

(56) References Cited

U.S. PATENT DOCUMENTS 5,674,561 A * 10/1997 Dietz et al. ..... 427/208.4
7,905,993 B2 * 3/2011 Funahashi ..... 204/196.18

(Continued)

FOREIGN PATENT DOCUMENTS

JP 2003/027607 A 5/2001
JP 2003027607 * 5/2001 ..... 204/196.01

(Continued)

OTHER PUBLICATIONS

Moriwake et al (Machine translation of JP 2003-027607).*

(Continued)

*Primary Examiner* — Luan Van
*Assistant Examiner* — Alexander W Keeling
(74) *Attorney, Agent, or Firm* — R. Neil Sudol; Henry D. Coleman

(57) ABSTRACT

To provide an anode, corrosion-protecting structure of a concrete constructions using this, and a corrosion protection method capable of protecting electrical corrosion, with little generation of gas due to electrolysis of water or chlorine compounds, by decreasing as far as possible the amount of processing performed on the structural body in on-site construction work and suppressing the voltage that is conducted therethrough to a low level. [Solution] A corrosion-protecting structure (1) is constituted by attaching an anode (10) to the surface layer (3) of a corrosion-protecting body (4) through a first electrolyte layer (12) on one face of a conductive layer (11) formed as a sheet. The electrolyte is formed as a sheet. The first electrolyte layer (12) having adhesiveness is attached to the conductive layer (11) and the surface layer (3) of the corrosion-protecting body (4).

10 Claims, 3 Drawing Sheets

(56) References Cited

U.S. PATENT DOCUMENTS

| | | | | |
|---|---|---|---|---|
| 2007/0175750 | A1* | 8/2007 | Schwarz | 204/196.01 |
| 2009/0029257 | A1* | 1/2009 | Ando et al. | 429/231.95 |

FOREIGN PATENT DOCUMENTS

| | | | |
|---|---|---|---|
| JP | 2004/190119 | A | 12/2002 |
| WO | 9520690 | † | 8/1995 |

OTHER PUBLICATIONS

M. Raupach, Sacrificial Cathodic Protection of RC-Structures using a Zinc-Hydrogel Anode-Investigations on the Effectiveness, 2003, American Concrete Institute.†

* cited by examiner
† cited by third party

ANODE, CORROSION-PROTECTING STRUCTURE FOR CONCRETE CONSTRUCTIONS USING THIS, AND CORROSION PROTECTION METHOD

BACKGROUND OF THE INVENTION

1. Field of the Invention

The present invention relates to an anode used for corrosion protection of a reinforcing steel covered with a concrete layer, a corrosion-protecting structure of a concrete constructions using the same and a corrosion protection method of the concrete constructions.

2. Description of the Conventional Art

There has been known an electric corrosion protection which lowers an electric potential of a steel product to a corrosion-free electric potential by applying an electric current to the steel product such as a reinforcing steel in a concrete from an electrode (an anode) which is installed in the vicinity of a surface of the concrete, thereby suppressing progress of the corrosion of the steel product. An impressed current system and a galvanic anode have been known as the electric corrosion protection.

The impressed current system is a cathode corrosion protection in which an electric circuit is produced by connecting a positive pole of a DC power supply device to a steel product corrosion protecting an anode and a negative pole by an electric conductor, and a corrosion protection current is applied to the steel product from the anode.

The galvanic anode system is structured such that a galvanic anode (a sacrificial anode) is connected to the steel product by the electric conductor, the galvanic anode being made of a material having a lower oxidation-reduction potential than the steel product to be electrically corrosion protected, for example, a base metal such as zinc, magnesium or aluminum or alloys thereof, and the metal of the galvanic anode is ionized in place of the steel product so as to prevent corrosion of the steel product. In other words, the galvanic anode system is a method of completing an electric battery by using the corrosion protecting steel product as the cathode and using a material having a lower oxidation-reduction potential than the steel product as the anode, and flowing a corrosion protection current to the steel product on the basis of difference in potential between both the electrodes.

However, since the galvanic anode system depletes the material having the low oxidation-reduction potential with age, the galvanic anode system has such a problem that it is necessary to periodically change the galvanic anode.

On the other hand, since the impressed current system is structured such that the anode having a high corrosion resistance such as a titanium mesh, a titanium grid or a titanium rod is installed to a surface of the concrete or installed by forming a groove or a hole on the surface, and is fixed by a mortar, it is not necessary to periodically change the anode, however, there is such a problem that the anode having the high corrosion resistance is expensive and is disadvantageous in cost, and it takes a lot of trouble with construction.

Further, there is a method of attaching platinum titanium wires to a concrete surface at intervals, and coating a whole surface of the concrete with a conductive coating material, however, since an electric potential distribution of a contact surface between a conductive coating film and the concrete is not uniform, there is such a problem that the conductive coating film is deteriorated by an electrochemical reaction and tends to be peeled.

With regard to the problems mentioned above, in recent years, there has been proposed a corrosion protection method utilizing a carbon fiber or a carbon powder while paying attention to the carbon fiber which is used for reinforcing at the time of repairing the concrete constructions.

For example, patent document 1 proposes an electric corrosion protection method of a reinforced concrete, the method attaching a material having a specific air permeability which is hard to pass salt content and water content to an inner side, attaching a sheet coated with a nonwoven fabric of a carbon fiber or a carbon powder to an inner side thereof, further attaching a protection cover coated with a non-shrink mortar in an inner side thereof to the outside of the reinforced concrete constructions, connecting a metal having a high corrosion resistance and the sheet in an end portion of the protection cover so as to form a current-carrying point in an anode side, forming a hole in the concrete at an appropriate position, and connecting the metal to the reinforcing steel so as to form a current-carrying point in a cathode side.

Further, patent document 2 proposes a corrosion protection method of attaching a carbon fiber sheet onto a surface of the existing concrete constructions including a steel product provided within the concrete, via a conductive adhesive agent, and applying an electric current so that the steel product is a cathode and the carbon fiber sheet is an anode.

Further, patent document 3 is proposed since it is hard to freely adjust a conductive property and an adhesion strength of the conductive adhesive agent in the proposal in the patent document 2, and proposes a corrosion protection method of applying an electric current so that a cathode is constructed by a steel product of a corrosion protection reinforced concrete assembly in which an adhesive agent layer for bonding a concrete constructions and a carbon fiber sheet is arranged so as to be sectioned from a layer of a conductive material having a higher conductive property than the adhesive agent, the adhesive agent layer and the steel product being arranged between a surface of the concrete constructions and the carbon fiber sheet, and an anode is constructed by the carbon fiber sheet.

Further, combination of a backfill is carried out as a means for assisting the proposals. For example, patent document 4 proposes a backfill for an electric corrosion protection of a concrete constructions which includes a water-absorbing resin and an alkaline aqueous solution and is in a gel state. According to the proposal, it is possible to prevent a liquid leakage of the backfill even in the case that the electric current is applied for a long time, an ionic conductive property and a water property are good, an excellent alkali buffer action is exhibited, and it is possible to apply such a service life property that an exciting performance is less reduced.

PRIOR ART DOCUMENT

Patent Document

Patent Document 1: Japanese Unexamined Patent Publication No. 2003-27607
Patent Document 2: Japanese Unexamined Patent Publication No. 11-200516
Patent Document 3: Japanese Unexamined Patent Publication No. 2004-27709
Patent Document 4: Japanese Unexamined Patent Publication No. 2008-127678

SUMMARY OF THE INVENTION

Problem to be Solved by the Invention

However, the proposal of the patent document 1 is structured such as to let out gas such as oxygen and chlorine which is generated by an electrochemical reaction, to an external portion, by bonding a breathable carbon sheet to the concrete by the mortar, however, since an electrolysis occurs in an interface between the carbon sheet and the mortar at the exciting time and the gas is generated, there is such a problem that a chap or a crack is formed in the mortar, and the carbon sheet tends to be peeled off. Accordingly, in the proposal of the patent document 1, the carbon sheet is fixed by screw fastening a rigid protection cover such as an FRP mold form. As a result, the carbon sheet is not peeled off, however, the carbon sheet and the mortar are insufficiently bonded due to the generated gas with age, and the electric current is hard to flow due to the reduction of degree of adhesion. Therefore, it is necessary to apply a higher electric voltage for securing a predetermined corrosion protection current.

On the other hand, since the proposal of the patent document 2 is structured such that the carbon fiber sheet is attached onto the surface of the concrete constructions via the conductive adhesive agent, it is possible to obtain an adhesion force which has a higher reliability in comparison with the case that the bonding by the mortar. Further, since an electric potential distribution of the concrete surface becomes uniform at the time of carrying out the electric corrosion protection, on the basis of the conductive property of the carbon fiber sheet, and it is possible to reduce the generation of the chlorine gas, it is possible to achieve the corrosion protection without enhancing the applied electric voltage.

However, in the case that content rate of the conductive property particles of the carbon and the metal in the conductive adhesive agent is raised for increasing the conductive property, the adhesion force is lowered. Further, in the case that the content rate of the conductive property particles of the carbon and the metal in the conductive adhesive agent is lowered for reducing the adhesion force, the conductive property is lowered. Therefore, it becomes hard to freely adjust the conductive property and the adhesion strength of the conductive adhesive agent.

The proposal of the patent document 3 which solves the problem in the proposal of the patent document 2 is structured such that the adhesive agent layer for bonding the concrete constructions surface and the carbon fiber sheet is arranged so as to be sectioned from the layer of the conductive property material having the higher conductive property than the adhesive agent. In other words, since the adhesive agent layer and the conductive layer are provided in a stripe manner, it is possible to adjust the conductive property and the adhesion strength of the conductive adhesive agent freely to some degree.

However, the electric potential distribution of the concrete surface becomes uneven between the portion in which the conductive layer exists and the portion in which the conductive layer does not exist; and it is necessary to make the applied electric voltage higher to some degree for obtaining a predetermined electric current which is necessary for the corrosion protection.

Further, the work of providing the adhesive agent layer and the conductive layer in the stripe manner is achieved by a field construction, and is necessarily carried out overhead in the corrosion protection construction which is frequently applied to a back surface of the structure such as a floor plate of a bridge, so that the construction is extremely complicated and is not practical.

Further, in any of the proposals in the patent documents 1 to 3, even if the carbon sheet can be adhered to the surface of the concrete layer, an energy barrier is great in the interface between the concrete and the conductive adhesive agent when the movement of a positive electric charge caused by an electric current supplied from a positive pole of an external power supply changes to the movement of the positive electric charge which is transported to the reinforcing steel on the basis of an ionic conduction in the concrete. In the case that an electrochemical polarization is generated by the barrier, and a predetermined electric current necessary for corrosion protection is applied, the applied electric voltage becomes higher. Therefore, in any of the proposals in the patent documents 1 to 3, it is hard to hold down the applied electric voltage so as to achieve the electric corrosion protection in which the gas generation by the electrolysis of the water and the chlorine chemical compound is less.

Further, in any of the proposals in the patent documents 1 to 3, the work of adhering the concrete surface and the carbon sheet is mainly achieved by the field construction, and it is necessary to carry on the work while taking into consideration the time for which the mortar or the adhesive agent is dried or cured. In some cases, there is a case that it is necessary to wait until the mortar or the adhesive agent is dried or cured. Further, in the corrosion protection construction in which the back surface such as the floor plate of the bridge is frequently treated, the field construction tends to be a hard work.

Further, for example, even by employing the backfill as described in the patent document 4, the backfill itself does not have a function of reinforcing the adhesion between the concrete surface and the carbon sheet. Therefore, in the electric current application for a long period, the degree of adhesion between the concrete surface and the anode is lowered, the electrochemical polarization becomes larger, and the rising of the applied electric voltage is unavoidable. Further, since the work of fixing the outer container to the concrete constructions surface and filling with the backfill is added, this structure does not contribute to the reduction of the working amount in the construction field.

The present invention is made by taking the circumstances mentioned above into consideration, and an object of the present invention is to provide an anode which can reduce a working amount in a construction field as much as possible, can hold down an applied electric voltage and can achieve an electric corrosion protection in which gas is less generated by an electrolysis of water and chlorine chemical compound, a corrosion-protecting structure of a concrete constructions using the same, and a corrosion protection method.

Means for Solving the Problem

The inventors of the present invention have devoted themselves to make a study of an anode in which an electric potential distribution of a concrete surface is uniform at the time of carrying out an electric corrosion protection, and a movement of an electron to an external power supply is efficiently converted into a movement of a positive ion in the concrete, for solving the problem mentioned above. As a result, they have conceived using an electrolyte layer formed as a sheet having adhesive power possible to attach to the surface of the concrete. For example, a sheet of a gel electrolyte such as a conductive hydro gel (hereinafter, refer also to as "hydro gel") can be made smaller its electrochemical polarization in an interface with a conductive layer by an ion which is included in a solvent of the gel (water in the case of the hydro gel) which is richer in comparison with the concrete. Further, the anode can be attached to the surface of the concrete on the basis of an adhesion property of a resin matrix constructing the gel electrolyte. As a result, since an adhesion between the gel electrolyte and the concrete layer becomes higher, an ion conduction tends to be caused. Further, it is possible to reduce a work rate in the construction field at the time of installing the anode. The inventors of the present invention have completed the present invention on the basis of the knowledge.

The present invention provides the following anode.

(1) An anode comprising the conductive layer formed as a sheet, and a first electrolyte layer formed as a sheet and having adhesive power possible to attach to the conductive layer and a surface layer of an object to be protected from corrosion, wherein the first electrolyte layer is attached to one surface of the conductive layer.

(2) The anode according to the item (1), wherein the conductive layer includes carbon material.

(3) The anode according to the item (2), wherein the carbon material is supported by a base of fiber or a base of film.

(4) The anode according to the item (3), wherein the carbon material is carbon powder.

(5) The anode according to any one of the items (1) to (4), wherein the conductive layer has many gas permeable apertures.

(6) The anode according to any one of the items (1) to (5), wherein the conductive layer has many ion permeable apertures, and a second electrolyte layer which has an electrolyte formed as a sheet and has an adhesive power possible to attach to the conductive layer is attached to the other surface of the conductive layer.

(7) The anode according to any one of the items (1) to (6), wherein the outside of the conductive layer or the second electrolyte layer is covered with a protection layer.

Further, the present invention provides the following corrosion-protecting structure of the concrete constructions and the following corrosion protection method of the concrete constructions.

(8) A corrosion protection structure for concrete constructions, concrete constructions wherein the anode according to any one of the items (1) to (7) is attached to a surface of the concrete constructions by using the first electrolyte layer, the conductive layer of the anode is connected to a positive pole of an external power supply, and a negative pole of the external power supply is connected to the an object to be protected from corrosion.

(9) A corrosion protection method of a concrete constructions, the method applying an electric voltage between the conductive layer of the anode and the an object to be protected from corrosion so as to apply a corrosion protection current, by using the corrosion-protecting structure of the concrete constructions according to the item (8).

Effect of the Invention

According to the anode of the item (1), since the first electrolyte layer having the electrolyte formed as the sheet and having the adhesive power possible to attach to the conductive layer and the surface layer of the an object to be protected from corrosion is attached to one surface of the conductive layer so as to form a laminated structure, it is possible to attach the anode to the surface layer of the an object to be protected from corrosion by using the surface to which the conductive layer is not attached in the first electrolyte layer. As a result, it is possible to widely reduce a work rate in the construction field for installing the anode.

Further, since the conductive layer formed as the sheet and the gel electrolyte formed as the sheet are closely contacted uniformly in a wide area, an electric potential distribution of the surface layer of the an object to be protected from corrosion becomes uniform at the time of carrying out an electric corrosion protection. Further, since the movement of the electric charge from the external power supply is efficiently converted into the ion conduction of the electrolyte by the ion of the electrolyte which is richer in comparison with the concrete, it is possible to make an electrochemical polarization smaller. As a result, since it is possible to set the electric voltage applied to the anode lower, it is possible to reduce generation of gas on the basis of an electrolysis of water and chlorine chemical compound.

Further, since the anode 10 according to the present invention can obtain a corrosion protection effect even if the applied electric voltage is small, the anode can achieve the corrosion protection by using an independent power supply such as a solar battery, a fuel battery or a dry battery, without using any commercial power source requiring a power supply unit which is expensive and takes a lot of trouble for installation.

Further, since the anode 10 according to the present invention employs the electrolyte layer in a contact point with the concrete, the anode does not come into direct contact with a foreign body. Therefore, the anode according to the present invention can scale back the influence of a short circuit and an electric corrosion.

According to the anode of the item (2), in addition to the effect of the anode of the item (1), since any metal having a high corrosion resistance such as an expensive titanium is not necessarily used for the anode, an advantage in cost can be obtained. Further, since the carbon material is lighter than the metal, it is possible to make the anode lighter.

According to the anode of the item (3), in addition to the effect of the anode of the item (2), since the carbon material can be supported to the base material of the synthetic resin, the corrosion resistance is high, and it is possible to adjust a conductive property and achieve a cost reduction.

According to the anode of the item (4), in addition to the effect of the anode of the item (3), since the inexpensive carbon power can be used, an advantage in cost can be obtained.

According to the anode of the item (5), in addition to the effects of the anode of the items (1) to (4), since the conductive layer has many gas permeable apertures, it is possible to release the gas generated in the interface with the first electrolyte layer, in the case that the corrosion protection is achieved by applying a great electric current. As a result, it is possible to prevent the conductive layer from being partly peeled off from the first electrolyte layer. Therefore, in relation to the reinforcing steel in which the corrosion progresses, the corrosion can be restrained by applying the electric voltage flowing the great electric current, as a first stage, and the corrosion protection can be achieved by applying the electric voltage which less generates the gas on the basis of the electrolysis of the water and the electrolyte as a second stage in the case that a passive state membrane is formed.

According to the anode of the item (6), in addition to the effects of the anode of the items (1) to (5), since the second electrolyte layer solidified as the sheet is further attached to the other surface to which the first electrolyte layer of the conductive layer is not attached, both surfaces of the conductive layer can be closely contacted with the electrolyte layer. As a result, since the electronic conduction is converted into the ion conduction in both surfaces of the conductive layer, it is possible to make the electrochemical polarization further smaller.

According to the anode of the item (7), in addition to the effects of the anode of the items (1) to (6), it is possible to prevent physical damage and soil of the conductive layer or the second electrolyte layer, and intrusion of rain water and flying salt content without reduction of a handling property and a construction property of the anode.

According to the corrosion-protecting structure of the item (8), in addition to the same effects as those of the anode of the items (1) to (7), the construction of the corrosion protection is easily carried out, the work rate in the construction field is widely reduced, and it is possible to achieve the corrosion protection of the concrete constructions without any risk of peeling of the anode.

According to the corrosion protection method of the item (9), in addition to the same effects as those of the corrosion-protecting construction of the item (8), since it is possible to hold down the applied electric voltage even in the case that the great electric current is used for the corrosion protection, it is possible to carry out a stable electric corrosion protection for a long period.

DESCRIPTION OF REFERENCE NUMERALS

Figure 1:
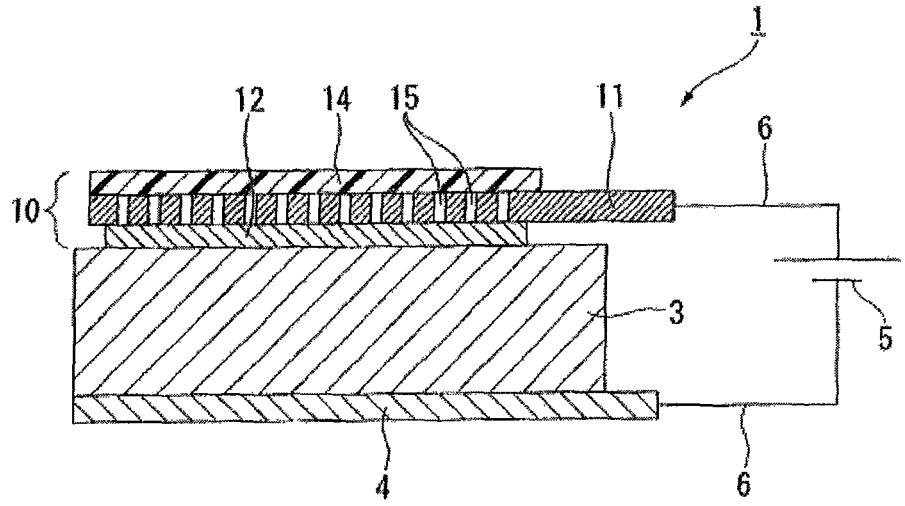
FIG. 1 is a cross sectional view schematically showing a corrosion-protecting structure of a concrete constructions using an example of an anode according to the present invention.

1, 2 corrosion-protecting construction of present invention
3 surface layer (concrete layer)
4 an object to be protected from corrosion (iron plate)
5 external power supply
6 circuit wiring (conducting wire)
10 anode
11 conductive layer
12 first electrolyte layer
13 second electrolyte layer
14 protection layer
15, 16 aperture (through hole)

DETAILED DESCRIPTION OF PREFERRED EMBODIMENTS

A description will be given below of the present invention on the basis of preferable embodiments with reference to the accompanying drawings.

FIG. 1 schematically shows an example of an anode 10 according to the present invention and a first embodiment of a corrosion-protecting structure of a concrete constructions using the same.

A corrosion-protecting structure 1 of the concrete constructions using the anode 10 according to the present embodiment installs the anode 10 by attaching a first electrolyte layer 12 to a surface of a concrete layer 3. Further, a positive pole of an external power supply 5 is connected to the conductive layer 11 of the anode 10 by using a circuit wiring 6, and a negative pole of the external power supply 5 is connected to a an object to be protected from corrosion 4 by using the circuit wiring 6 so as to form a corrosion protection circuit.

Here, "attach" means integration of objects according to adhesion or sticking. The adhesion means integration of objects with such an adhesion strength that can be peeled off in an intentional interface, however, can not be peeled off in a natural state. The sticking means integration of objects with such an adhesion strength that can not be peeled off in the interface.

The conductive layer 11 is a sheet electrode which uniformly supplies an electric current supplied from the external power supply 5 to a surface of the first electrolyte layer 12. The conductive layer 11 is obtained by forming a material having a high durability (corrosion resistance) against gas such as oxygen and chlorine which are generated at the time of applying the electric current, and an electrolyte solution, as a sheet.

As the material having the high corrosion resistance used for the conductive layer 11, there can be listed up a metal such as platinum, titanium, nickel, lead and a stainless steel, and carbon material.

Among the metal having the high corrosion resistance, the titanium is preferable since it is excellent in the corrosion resistance, light and soft. The stainless steel is preferable since it is advantageous in cost. In the case that platinum or ruthenium is plated, the stainless steel and the titanium are preferable since they are excellent in the corrosion resistance and the conductive property.

In the case that the metal is used for the conductive layer 11, it is possible to use a structure obtained by forming a metal mesh such as a metal foil, a metal ribbon, a woven cloth of a metal fiber and an expand metal into a sheet. The metal ribbon or the metal mesh having an opening is light and inexpensive, however, there is a case that an adhesion strength in relation to the first electrolyte layer is inferior. Therefore, the metal foil is preferable as the metal used for the conductive layer 11.

In the case that the metal foil is used, a thickness thereof may be decided by taking into consideration an easiness for acquiring, a rigidity, a weight and a cost. For example, in the case that the titanium foil is used, the thickness thereof is preferably between 20 μm and 500 μm in the case that stainless foil is used, the thickness thereof is preferably 10 μm to 300 μm. If the foil is thicker than this range, the conductive layer becomes too heavy and has a chance of peeling off from the first electrolyte layer at the time of using for a long period. Further, the rigidity is high and is hard to be processed. Further, in the case that the anode is constructed as a bent surface, the foil is hard to follow the bent surface.

In the case that the metal ribbon is used, a plurality of foils can be used in line for enlarging a width. In this case, it is preferable that the metal ribbons are electrically connected by a conductive body.

Among the materials having a high corrosion resistance used for the conductive layer 11, a carbon material is preferable since it is light, and is easily applied flexibility, and reservation of conductive property is compatible with cost reduction by adjusting the carbon material.

In the case that the carbon material is used for the conductive layer 11, it is possible to use a graphite sheet processed a graphite into a sheet, a conductive sheet made of carbon material such as a woven cloth, a nonwoven fabric sheet and a knitted cloth of a carbonized fiber of an organic fiber, a carbon mixed paper having a conductive property, and a sheet obtained by coating or soaking conductive carbon material such as a carbon short fiber or a carbon powder into a sheet-like base of fiber such as a base of film, a woven cloth, a nonwoven fabric sheet, the knitted cloth a paper, or the like. In the sheet of a carbon fiber, a part of the fiber may not be a carbon fiber.

Here, the coating means putting a carbon material mainly on the surface of a base of film or a base of fiber, and the soaking means putting the carbon material on the surface of a base of fiber and penetration into an inner portion. However, in the case that a carbon material is put on the surface of a base of fiber, the carbon material frequently penetrates into gaps of the base of fiber. In the present invention, since it is preferable that the conductive property of the conductive layer 11 becomes higher by the penetration of the carbon material, it is not necessary to strictly distinguish the coating and the soaking. In the following description, the soaking may be expressed broadly expressed as "coating".

Since it is costly advantageous to use the carbon coated sheet obtained by coating a carbon material as the conductive layer 11, and it is easy to adjust the conductive property, the carbon coated sheet is preferable.

The material of the base of film or the base of fiber supporting a carbon material in the carbon coated sheet can employ metal, carbon material, synthetic resin, glass, cotton, linen, wool, silk or the like.

Among them, a base material made of the metal is preferable since it is excellent in the conductive property, however, may be corroded by gas such as oxygen or chlorine and electrolyte solution (electrolysis solution) generated at the time of applying the electric current. As a result, it is necessary to use platinum or titanium which has a high corrosion resistance, and this is costly disadvantageous. Therefore, the carbon coated sheet supporting a carbon material with the base material of synthetic resin is preferable since corrosion resistance becomes higher, and adjustment of conductive property and cost reduction can be achieved.

The conductive layer constructed by the carbon coated sheet obtained by coating the carbon material to the base of fiber (hereinafter, refer also to as "fiber conductive layer") is preferable since a contact area between the conductive layer 11 and the first electrolyte layer 12 becomes larger on the basis of concavity and convexity of the surface of the base of fiber. Further, in the case that the first electrolyte layer 12 employs a gel electrolyte layer which has an adhesion property, is flexible, and is excellent in a tracking property to the concavity and convexity, a part of the gel intrudes into the gaps of the base of fiber, and the adhesion is increased. As a result, the gel electrolyte efficiently ionizes and receives positive electric charge which is fed from the positive pole of the external power supply 5, and can efficiently move positive electric charge to the surface layer 3 of an object to be protected from corrosion 4 on the basis of an ionic conduction. Further, by coating a carbon material so that the gaps of the base of fiber come to permeable apertures capable of transmitting gas, it is possible to let out the gas generated through the gaps of the base of fiber in the case that the great electric current is used at the corrosion protecting time.

As the base of fiber of the fiber conductive layer, it is possible to employ a base of fiber material obtained by processing a conductive fiber such as a metal fiber or a carbon fiber, and a non-conductive fiber such as a glass fiber, an animal fiber, a plant fiber, a synthetic resin fiber or the like into a sheet such as a woven cloth, a nonwoven fabric, a knitted cloth, a paper or the like.

The base of fiber constituted by a metal fiber is excellent in conductive property, however, may be corroded as passing of time on the basis of the generation of electrolyte solution or gas. In this case, it is preferable to coat a carbon material which is excellent in the corrosion resistance. In this case, since a whole of the fiber conductive layer becomes conductive, the conductive property is high.

Among the base of fiber of the fiber conductive layer, the base of fiber constituted by the synthetic resin fiber is preferable since it has a high corrosion resistance.

As the resin constituting a synthetic resin fiber which comes to the base of fiber, there can be listed up a polyester resin such as a polyethylene terephthalate (PET) or a polyethylene naphthalate (PEN), a fluorocarbon resin such as a polytetrafluoro-ethylene (PTFE) or an ethylene tetrafluoroethylene copolymer (ETFE), a polyolefin resin such as a polyethylene (PE) or a polypropylene (PP), a polyamide resin such as a nylon, a tetra acetyl cellulose (TAC), a polyester sulfon (PES), a poly phenylene sulfide (PPS), a polycarbonate (PC), a polyarylate (PAr), a polysulfon (PSF), a polyether imide (PEI), a polyacetal, a polyimide polymer, a polyethersulfone, and so on.

The conductive layer (hereinafter, refer also to as "film conductive layer") obtained by coating a carbon material to a base of film is preferable because it can precisely control a coating amount of the carbon material. Further, since the carbon material does not penetrate to the back side of the film, it is possible to coat with a general-purpose simple coating device.

However, there is a case that it is hard to coat a carbon material thickly if the base material is constructed by a film. In such case, the carbon material may be coated onto both surfaces of the film. In this case, it is preferable to make the front and back carbon coated layer conductive forming the film porous or connecting the front and back sides by a conductive tape. Further, the carbon coated layer may be reinforced by burying fiber material in the carbon coated layer.

The film conductive layer happens to be hard to pass gas through in some kinds of base of film. Generally, in the case that the small electric voltage equal to or less than 2 V is applied at the corrosion protecting time, a gas generation amount is extremely small, and the generated gas transmits the base of film. As a result, no problem is caused. However, in the case that the electric current amount allowing a demineralizing treatment or a re-alkalization is necessary for corrosion protecting the reinforcing steel in which the corrosion has made progress, the generated gas can be let out by the provision of a lot of through holes 15 in the film conductive layer. In this case, an inner diameter of the through hole 15 is preferably as small as possible so long as the gas can transmit. However, since both of the base film and the carbon coated layer are perforated, it is preferable to set such a magnitude as about 0.1 to 1 mm, so as to prevent from clogging. Further, in the case that the thickness of the carbon coated layer is large, it is preferable to make the diameter of the through hole 15 relatively large.

For forming the through hole 15, it is possible to employ a known method such as a punching method, a laser beam method or a perforation method using a heated needle or a cooled needle. The punching perforation by using a punch can obtain a hole having a comparatively larger diameter in comparison with the perforation using the heated needle or the cooled needle. In the perforation using the cooled needle, the periphery of the hole is in an irregularly divided state, and does not form a definite opening hole, however, can transmit the gas. In the melting perforation using the laser beam or the heated needle, a peripheral edge of the hole is molten and solidified so as to form a definite opening hole, and a reduction in strength of the conductive layer 11 is comparatively small even by the provision with a higher density. Accordingly, this method is preferable.

The shape of the through hole 15 can be formed as a circular shape, an oval shape, a square shape, a rectangular shape, a polygonal shape, an indefinite shape and the other optional shapes.

As the base of film used in the film conductive layer, a resin film is preferable since it is excellent in the corrosion resistance and can be easily formed into a film. As the resin forming the resin film, there can be listed up the same resins as the resins constituting the base of fiber mentioned above.

A thickness of the base of film used in the film conductive layer is not limited as long as a physical strength can be secured, however, can be normally set between about 10 μm and 100 μm.

The carbon material coated to the base material of the fiber conductive layer and the film conductive layer preferably employs a carbon powder constituted by a conductive carbon.

As the conductive carbon, it is possible to employ, for example, graphite, various carbon blacks such as Ketjen black, thermal black, acetylene black, channel black and furnace black, carbon nanotube and so on. Among them, graphite, Ketjen black and carbon nanotube are preferable because the conductive property is high. Especially graphite, which is inexpensive and has a high conductive property, is preferable. The carbon powder may include a carbon short fiber.

Employing a carbon material as a conductive particle is more inexpensive in comparison with employing a noble metal such as platinum or gold as a conductive particle, and is more excellent in a chemical stability in comparison with employing a base metal such as nickel or zinc as a conductive particle. As a result, it is possible to enhance a durability against the corrosion in a long time by generation of electrolyte solution or electric current in the conductive layer 11 constructed by the fiber conductive layer or the film conductive layer.

As a method of coating the carbon material to the base of fiber or the base of film, for example, there can be listed up a method of dispersing the carbon powder or the carbon short fiber into a solvent like organic solvent or water so as to form a paste state, and coating the obtained carbon paste, for example, by a coating method such as a dipping method, a gravure coating method, a bar coating method or a screen coating method and drying. An addictive such as a dispersing agent may be blended in the carbon paste, for improving dispersibility of the carbon material. Further, a resin component may be blended as a binder in the carbon paste for facilitating the coating work and the formation of the coated layer. The more the added amount of the binder is, the more preferable the formation of the coated layer is. However, since the binder is left in the conductive layer 11 when the solvent is evaporated, the binder may obstruct the contact between the conductive particles. Therefore, the carbon paste is preferably blended with the binder while taking the conductive property into consideration.

The first electrolyte layer 12 is an electric charge transmitting layer which includes ions having positive and negative electric charges and is solidified into a sheet. The electric charge is transmitted on the basis of an ionic conduction by movement of the ions included in the first electrolyte layer 12 or transmitting of the electric charge between the ions. As the main electrolyte used in the first electrolyte layer 12, there can be listed up a gel electrolyte in which the electrolyte solution is supported by the resin matrix, a polymer electrolyte such as an ion gel in which an ion liquid (an organic room temperature molten salt) constituted by a positive ion such as an imidazolium ion or a pyridinium ion and a negative ion such as $BF^{4-}$ or $PF^{6-}$ is supported by the resin matrix, and a true polymer electrolyte in which a lithium salt such as a bis (trifluoro methane sulfonyl) imide lithium (LiTFSI) is supported by the polyether resin.

Among them, the gel electrolyte is preferable because it has a high ionic conduction and gains flexibility easily. The gel electrolyte is obtained by gelating (solidifying) a electrolyte solution into the resin matrix by addition of polymer or oil gelating agent, polymerization of including multifunctional monomer, cross-linking reaction of the polymer or the like.

The first electrolyte layer 12 is a layer which sticks to the surface layer 3 of the anode 10 to the ion transmitting surface layer 3 existing on the surface of the an object to be protected from corrosion 4 such as the concrete layer or the coating material membrane, and transfers electric charge converting electron movement (electron transfer) achieved by electric current supplied from the positive pole of the external power supply 5 to the conductive layer 11 into the ionic conduction. It is preferable. that the first electrolyte layer 12 is a gel electrolyte which is a soft adhesive layer, since a part of the electrolyte layer enters into the micro concavity and convexity of the concrete layer 3 in the case that the anode 10 is attached to the surface layer of the an object to be protected from corrosion 4, for example, the concrete layer 3, so that the electrolyte layer can come into contact and be attached with the high adhesion strength and the wide contact area.

The thickness of the gel electrolyte layer used in the first electrolyte layer 12 is not particularly limited, however, is preferably set between 100 μm and 1000 μm. If the first electrolyte layer 12 is thicker than this range, any problem is not caused, however, a costly disadvantage is caused. If the first electrolyte layer 12 is thinner than this range, an adhesive power may come short. Further, moving capability of electric charge may be lowered in the case that the electrolyte solution in the gel electrolyte is absorbed into the concrete layer 3.

The gel electrolyte used in the first electrolyte layer 12 is preferably constructed by a conductive polymer gel electrolyte having adhesion property which is obtained by supporting the solvent and the electrolyte salt, preferably further a wetting agent into the resin matrix co-polymerized monomer for cross-linkage in monomer for polymerization. It is necessary for the polymer gel electrolyte to support the solvent in the liquid state to a three-dimensional mesh structure of polymer chains combined physically or chemically, and to maintain its shape.

In the polymer gel electrolyte used in the first electrolyte layer 12, a skeleton (a resin matrix) of a flexible polymer three-dimensional mesh structure can form by designing appropriately the polymer three-dimensional mesh structure. The polymer gel electrolyte having the skeleton mentioned above has an appropriate cohesive power, and is good in its wettability onto the surface of a attached body. Therefore, it is possible for the contact portion with the attached body to come close in a molecular level. Further, since a compression strength and a tension strength are brought to the gel by the appropriate cohesive power of the polymer gel electrolyte, a high adhesive bonding property can be obtained by a mutual intermolecular force.

In the resin matrix of the polymer gel electrolyte used in the first electrolyte layer 12, it is preferable for enhancing the cohesive power to apply the cross-linking treatment by the cross-linking agent or cross-link on the basis of the polymerization of monomer for polymerization and monomer for cross-linkage. The resin matrix in which the polymer chain is three-dimensionally cross-linked is excellent in a capacity of supporting the solvent or the wetting agent. As a result, it is possible to support the electrolyte salt into the resin matrix in a state of being dissolved in a molecular level.

The polymerized monomer forming the resin matrix is not particularly limited as long as the monomer has one carbon-carbon double combination capable of polymerization in the molecule. For example, there can be listed up a (meta) acrylic acid derivative such as a (meta) acrylic acid, a maleic acid, a fumaric acid, an itacoinic acid, a crotonic acid, a (poly) ethylene glycol (meta) acrylate, a (poly) propylene glycol (meta) acrylate and a (poly) glycerin (meta) acrylate, a (meta) acryl amide derivative such as a (meta) acryl amide, an N-methyl (meta) acryl amide, an N-ethyl (meta) acryl amide, an N-propyl (meta) acryl amide, an N-butyl (meta) acryl amide, an N,N-dimethyl (meta) acryl amide, a diacetone acryl amide, an N,N-dimethyl amino propyl (meta) acryl amide and a t-butyl acryl amide sulfonic acid, salts thereof, an N-vinyl amide derivative such as an N-vinyl pyrrolidone, an N-vinyl formamide and an N-vinyl acetamide, a sulfonic acid monomer such as a vinyl sulfonic acid and an aryl sulfonic acid, and their salts. Here, (meta) acryl means acryl or meth acryl.

As the monomer for cross-linkage which is polymerized with the monomer for polymerization so as to be cross-linked, it is preferable to use a monomer having two or more double combinations capable of polymerization in the molecule. Specifically, there can be listed up a multifunctional (meta) acryl amide monomer such as a methylene bis(meta) acryl amide, an ethylene bis (meta) acryl amide, an N,N-methylene bis acryl amide and an N-methylol acryl amide, a multifunctional (meta) acrylate monomer such as a (poly) ethylene glycol di (meta) acrylate, a (poly) propylene glycol di (meta) acrylate, a glycerin tri (meta) acrylate and a glycidyl (meta) acrylate, a tetra allyloxy ethane, and a diallyl ammonium chloride. Among them, the multifunctional (meta) acryl amide monomer is preferable, and the N,N-methylene bis acryl aminde is more preferable. The monomers for cross-linkage may be singly employed, or two or more may be combined.

As a content of the cross-linked monomer, 0.005 to 10 weight part is preferable in relation to 100 weight part of the resin matrix obtained by polymerizing and cross-linking the monomer for polymerization and the monomer for cross-linkage. If the content of the monomer for polymerization is less in the resin matrix, the number of mesh cross-linking points connecting between the main chains is small, and there is a case that the polymer gel electrolyte excellent in a shape retaining property can not be obtained. If the content of the monomer for cross-linkage is large, the number of the mesh cross-linking points connecting between the main chains is increased, although the polymer gel electrolyte having high shape retaining property In an appearance can be obtained, the polymer gel electrolyte becomes fragile, and the polymer gel electrolyte may tend to be tore or broken easily by the tension force or the compression force. Further, the polymer main chain becomes hydrophobic on the basis of the increase of the cross-linking point, it becomes hard to hold stably the solvent sealed in the mesh structure, and it becomes easy to be caused bleeding.

In order to enhance the capacity of supporting the solvent or the wetting agent of the polymer gel electrolyte and the cohesive power, a three-dimensional structure may be formed by newly impregnating monomer for polymerized and monomer for cross-linkage into the previously polymerized resin matrix and polymerizing again, in which different resin matrixes are penetrated to each other. The previously polymerized resin matrix may be cross-linked or not be cross-linked.

As the solvent which can be used in the polymer gel electrolyte, a polar solvent having high boiling point, low vapor pressure at room temperature, and compatibility with monomer for polymerizing and monomer for cross-linkage is preferable.

As the solvent mentioned above, there can be listed up, water, alcohols such as methanol, ethanol, isopropanol, and so on, cellosolves such as methyl cellosolve, ethyl cellosolve, butyl cellosolve, and so on, amides such as N,N-dimethyl formamide, N,N-dimethyl acetamide, N,N'-dimethyl-2-imidazolidinone, N-methyl-2-pyrrolidone, sulfolane, dimethyl sulfoxide, and so on. These solvents may be used by being mixed.

The solvent included in the polymer gel electrolyte is preferably between 5 and 50 weight %, and more preferably between 5 and 40 weight %. The solvent is less than the above mentioned range, the conductive property is not good, since the flexibility of the polymer gel electrolyte is poor and the electrolyte salt can be hardly added. The solvent is beyond the above mentioned range, bleeding of the solvent may occur, because the balance solvent supporting amount of the polymer gel electrolyte goes beyond greatly. Also, the solvent which can not be held may flow out, and a physical property may change with age.

In the case that the polymer gel electrolyte used in the first electrolyte layer 12 is constituted by a hydro gel obtained by holding water as the solvent a electrolyte salt and preferably further a wetting agent into a hydrophilic resin matrix, the water in the concrete layer 3 and the solvent are common. This structure is preferable because the ionic conduction becomes easy to cause in the interface between the concrete layer 3 and the first electrolyte layer 12.

The hydro gel can hold the electrolyte salt dissolved in water in a molecular level in the resin matrix. Further, the electrolyte water solution makes the moving speed of electric charge high, and makes it possible to enhance the flexibility and the adhesion property easily.

A moisture content of the hydro gel employed in the first electrolyte layer 12 is normally between 5 and 50 weight %, and preferably between 10 and 30 weight %. If the moisture content is low, the flexibility of the hydro gel may be lowered. Further, there may be a case that the ionic conductive property is lowered, and the capacity of moving electric charge is inferior. If the moisture content of the hydro gel is high, the water of which amount is beyond the amount capable of the hydro gel can hold may break away or evaporate, so that the gel may deflate or the physical property such as the ionic conductive property may greatly change. Also, since the gel is too soft, there is a case that the shape retaining property is inferior.

If the hydro gel employed in the first electrolyte layer 12 includes a wetting agent, it is possible to inhibit the moisture content of the hydro gel from being lowered. In a view point of adhesion property and shape retaining property, the wetting agent is adjusted to a range between 5 and 80 weight %, preferably to a range between about 20 and 70 weight %. If the content of the wetting agent in the hydro gel is small, a moisture retention force of the hydro gel may come short, the water content may tend to transpire, the hydro gel may be inferior in the stability with age and be inferior in the flexibility, and the adhesion property may be lowered. If the content of the wetting agent is large, a viscosity becomes too high and a handling property is lowered at the time of manufacturing the hydro gel, so that air bubbles may be mixed at the time of forming the hydro gel. Further, the contents of the resin matrix and the water become relatively smaller and there is a risk that the shape retaining property and the ionic conductive property may be lowered.

The wetting agent is not particularly limited as long as it can improve the supporting force of the solvent. For example, there can be listed up polyalcohols such as ethylene glycol, propylene glycol, butanediol, glycerin, pentaerythritol and sorbitol, polyols obtained by polymerizing one kind or two or more kinds of these polyalcohols as the monomer, and saccharide such as glucose, fructose, sucrose and lactose. The wetting agent may be used singly or two or more kinds may be combined. Further, the polyalcohols may have a functional group such as ester bond, aldehyde group and carboxyl group in a molecule of the polyalcohols or the terminal end of the molecule. Among them, the polyalcohols are preferable because they bring elasticity to the hydro gel in addition to the function of holding the water content. Among the polyalcohols, glycerin is particularly suitable in the light of a long period water retention property. The polyalcohols can be used by selecting one kind or two or more kinds from them. The polyalcohols which are in a liquid state at the room temperature are more preferable because they are excellent in the improvement of the elasticity of the hydro gel and the handling property at the manufacturing time. In the case that it is necessary to improve the elasticity of the hydro gel, a known filler such as titanium oxide, calcium carbonate, talc, and so on may be added.

As the electrolyte salt included in the hydro gel employed in the first electrolyte layer 12, it is possible to optionally select among electrolyte salts which are commonly used as a charge transport. The salt mentioned above is not particularly limited as long as the salt can apply the ionic conductive property to the hydro gel. For example, there can be listed up an alkali metal halide salt such as a sodium halide like NaCl and a potassium halide like KCl, an alkali earth metal halide salt such as a magnesium halide and a calcium halide, the other metal halides such as LiCl, inorganic salts such as sulfates, nitrates, phosphates, chlorates, perchlorates, hypochlorites, chlorites and ammonium salts of various metals like $K_2SO_4$ and $Na_2SO_4$, fluorine containing electrolyte salts like $LiPF_6$, $LiBF_4$ and LiTFSI, and various complex salts, monovalent organic carboxylates of an acetic acid, a benzoic acid, a lactic acid and a tartaric acid, monovalent or bivalent or higher salts of a phthalic acid, a succinic acid, an adipic acid and a citric acid, metal salts of organic acid such as a sulfonic acid and an amino acid, and salts of polymer electrolyte such as a poly (meta) acrylic acid, a polyvinyl sulfonic acid, a poly t-butyl acryl amide sulfonic acid, a poly allylamine, a polyethylene imine. It is possible to use materials which are insoluble or in a distributed state at the time of manufacturing the hydro gel, however, are dissolved in the hydro gel according to a time elapse, and a silicate salt, an aluminate, a metal oxide and a metal hydride can be listed up as the materials mentioned above.

The content rate of the electrolyte salt in the hydro gel is preferably between 0.01 and 20 weight %, and more preferably between 0.1 and 10 weight %. If the content is higher than this range, the electrolyte salt is hard to be completely dissolved in water, and may be deposited as a crystal in the hydro gel, or may obstruct the dissolution of other components. If the content is lower than this range, the electrolyte salt may be inferior in the ionic conductive property.

The hydro gel employed in the first electrolyte layer 12 becomes ionic conductive as long as it includes electrolyte, and can transmit electric charge. However, in the case that the hydro gel further includes an oxidation-reduction agent, the electric charge is more smoothly transmitted. As the oxidation-reduction agent mentioned above, there can be listed up organic type agents such as a quinine-hydroquinone mixture, and inorganic type agent such as $S/S^{2-}$ and $I_2/I^-$. Further, it is possible to preferably employ a metal iodide such as LiI, NaI, KI, CsI and $CaI_2$ and an iodine chemical compound of quaternary ammonium compound such as a tetraalkyl ammonium iodide, a pyridinium iodide and an imidazoline iodide.

Further, in order to adjust pH of the hydro gel, alkalis such as NaOH, KOH, and so on may be included.

As a manufacturing method of the hydro gel employed in the first electrolyte layer 12, for example, there can be listed up a cross-linking and polymerizing method of dissolving or dispersing a material obtained by adding a monomer for polymerization, a monomer for cross-linkage, a wetting agent, a polymerization initiator and an electrolyte salt into water, a method of impregnating an electrolyte salt into a resin matrix obtained by dissolving or dispersing a monomer for polymerization, a monomer for cross-linkage, a wetting agent and a polymerization initiator into water so as to cross-link and polymerize, and a method of creating the resin matrix by adding a cross-linking agent to a dispersion solution obtained by dissolving or dispersing electrolyte into a straight chain polymer obtained by dispersing only a monomer for the polymerization into water and polymerizing under existence of the wetting agent so as to cross-linking react the straight chain polymer and the cross-linking agent.

An antiseptic, a mildew proofing agent, an antirust, an antioxidant, a stabilizer, an interfacial active agent, and a coloring agent may be appropriately added to the hydro gel employed in the first electrolyte layer 12 as occasion demands.

A laminating method of the first electrolyte layer 12 can employ a known method. For example, there can be listed up a method of coating on the conductive layer 11 according to a coating method such as a gravure coat, a bar coat and a screen coat.

In the case that the first electrolyte layer 12 employs the hydro gel which is previously formed as a sheet, the sheet of the hydro gel has an adhesion property. Accordingly, it is possible to directly attach the sheet of the hydro gel to the conductive layer 11. This method is preferable in the case that the anode 10 is mass produced from roll to roll by using the conductive layer 11 wound into a roll and the hydro gel sheet wound into a roll.

In the case that the conductive layer 11 is cut as a sheet, a sol-state electrolyte layer may be formed by coating, on the conductive layer 11, the material obtained by dissolving or dispersing the material to which, in the water, a monomer for polymerization, a monomer for cross-linkage, the wetting agent, the polymerization initiator and the electrolyte salt are added, and may be gelated thereafter by radical polymerization.

In the case that the first electrolyte layer 12 is integrally wound into the roll or cut as a sheet so as to be superposed at the time of mass producing the anode 10 from roll to roll, it is preferable to laminate a release coated paper on a surface which is exposed to an outer side of the first electrolyte layer 12.

In the anode 10 according to the present embodiment, a protection layer 14 is laminated onto the conductive layer 11. The protection layer 14 is positioned on the surface of the anode 10 so as to shut off the water and the air and prevent the conductive layer 11 and the first electrolyte layer 12 from being soiled, deteriorated or broken. Accordingly, the protection layer 14 is preferably formed so as to cover a whole surface of the conductive layer 11 and the first electrolyte layer 12.

The protection layer 14 is preferably formed by dry laminating a resin film or extrusion laminating a resin, in the case that the conductive layer 11 is constructed by a metal foil or a carbon coated sheet. In the case that the conductive layer 11 has concavity and convexity such as a metal mesh and a punching metal, it is preferable to previously form the resin as a flat member such as a sheet or a plate, and adhesive bond a periphery thereof by an adhesive bonding agent such as an epoxy adhesive.

As the resin forming the protection layer 14, there can be preferably employed a fluorocarbon resin such as a poly vinylidene fluoride (PVDF), a polytetrafluoro-ethylene (PTFE) or an ethylene-tetrafluoroethylene copolymer (ETFE), an epoxy resin and an acrylic resin such as a methyl methacrylate (MMA) since they are excellent in an antipollution performance and a weather resistance. In addition, there can be listed up resins such as a polyester like a polyethylene, terephthalate (PET) and a polyethylene naphthalate (PEN), a tetra acetyl cellulose (TAC), a polyester sulfon (PES), a poly phenylene sulfide (PPS), a polycarbonate (PC), a polyarylate (PAr), a polysulfon (PSF), a polyether imide (PEI), a polyacetal, a transparent polyimide and a polyethersulfone.

Among these resins, the fluorocarbon resin is preferable because of excellent weather resistance. Further, the fluorocarbon resin can be formed as the protection layer 14 which discharges the gas such as oxygen and chlorine generated in the case that the corrosion protection is achieved by applying an electric current about 10 mA to 30 mA, without applying a process of arranging a lot of holes, since it has a low barrier property against the gas.

The protection layer 14 can be laminated by dry laminate as long as resin is formed as a film, and is preferable in the case that the anode 10 is mass produced from roll to roll. The film as mentioned above is preferably oriented for enhancing its strength.

A thickness of the protection layer 14 is preferably thin in the light of a discharging property of the gas such as oxygen and chlorine generated at the corrosion protecting time and a cost, as long as a physical strength is satisfied. Specifically, the thickness of the protection layer 14 is selected in a range between 10 and 200 μm, preferably between 20 and 100 μm. The protection layer 14 may be constructed by laminating a plurality of layers of the same kind of resin or different kinds of resins.

The protection layer 14 may be colored, or may be provided with a design such as letter information or patterns. Particularly, if the protection layer 14 is colored into gray type colors similar to a color of the surface of the concrete layer 3, it is preferable because the anode 10 is indistinctive.

In the forming method of the protection layer 14, the protection layer 14 is generally formed as a film and laminated to the conductive layer 11 by using an adhesive bonding agent. In the case that the conductive layer 11 is constructed by the film conductive layer, the surface of the base of film to which the carbon material is not coated may be used as the protection layer 14.

In the object to be protected from corrosion 4 to which the anode 10 according to the present invention is preferably applied, the material including nickel, titanium, copper or zinc is possible to be protected from corrosion other than the material including iron like a steel product (for example stainless steel). Further, the anode 10 can be attached directly to a surface of a metal covered with a concrete layer or a membrane of coating material and to an exposed metal or to a surface layer constructed by an ion permeable oxide membrane such as rust existing in the surface, and it is possible for them to protect from corrosion.

In the case that the object to be protected from corrosion 4 is buried in the concrete layer 3, a gel material including a water content exists in an extremely small gap in the concrete layer 3. Oft, $Na^+$, $Ca^{2+}$ and $K^+$ are main ions included in the gel material. Further, sodium chloride intrudes into the concrete layer of the structure near the sea where the necessity of corrosion protection is high. In other words, the concrete layer 3 is a solid state electrolyte layer in which an impedance is significantly large, and can serve as the ionic conductive layer by the ion. Further, since the water content in the concrete layer 3 is discharged into the air by being dried, or the concrete layer 3 absorbs the water content in the air on the basis of a rain water or a daily difference of temperature, the concrete layer 3 does not come to an absolute dry condition.

Further, in the object to be protected from corrosion 4 to which the anode 10 according to the present invention can be applied, an object to be protected from corrosion in which a coating material film is formed on a surface can be also applied. The coating material film looks like an electric insulation layer, however, a lot of cracks or fine holes to which the water content causing the corrosion enters exist on a surface of the coating film which requires an electric corrosion protection. The cracks and holes penetrate to the object to be protected from corrosion. Since the cracks or hole parts can not shut off the water content or the air, the water content exists. Accordingly, the ion can move in this part, and this part is ionic conductive. Therefore, this part can be corrosion protected by attaching the anode 10 according to the present invention to the coating film of a coating material. Further, since the corrosion protection may be applied to the part of the cracks and the fine holes, an extremely narrow area is corrosion protected. Therefore, even if the electron supply amount from the anode 10 is small, it is possible to achieve an extremely effective corrosion protection.

Further, in the case that the hydro gel is used as the first electrolyte layer 12, a part of the hydro gel enters into the cracks or the fine holes on the surface, and comes into contact with the object to be protected from corrosion, or is positioned extremely near the same. Therefore, it is possible to more securely achieve the corrosion protection.

Further, since the hydro gel has a resin matrix, the conductive layer 11 does not come into contact with a metal even if the anode 10 is directly adhesive bonded to the surface of the metal which forms the object to be protected from corrosion in the case of protecting corrosion the metal having a coating membrane, it does not come to a short circuit.

In the corrosion-protecting structure 1 of concrete constructions according to the present embodiment, the anode 10 is attached to the surface layer 3 of the concrete constructions by using the first electrolyte layer 12, the conductive layer 11 of the anode 10 is connected to the positive pole of the external power supply 5, and the negative pole of the external power supply 5 is connected to the object to be protected from corrosion 4 by using the circuit wiring 6.

The material of the circuit wiring 6 preferably has a corrosion resistance against the anode dissolution, for example, there can be listed up carbon, titanium, stainless steel, platinum, tantalum, zirconium, niobium, nickel, and nickel alloys such as Monel and Inconel. Among them, titanium is preferable because it is accessible and has a resistance against the anode dissolution over a wide range of electric potential.

Further, it is possible to employ an aluminum wire and a copper wire, which have no resistance against the anode dissolution, by covering with the resin layer.

Figure 2:
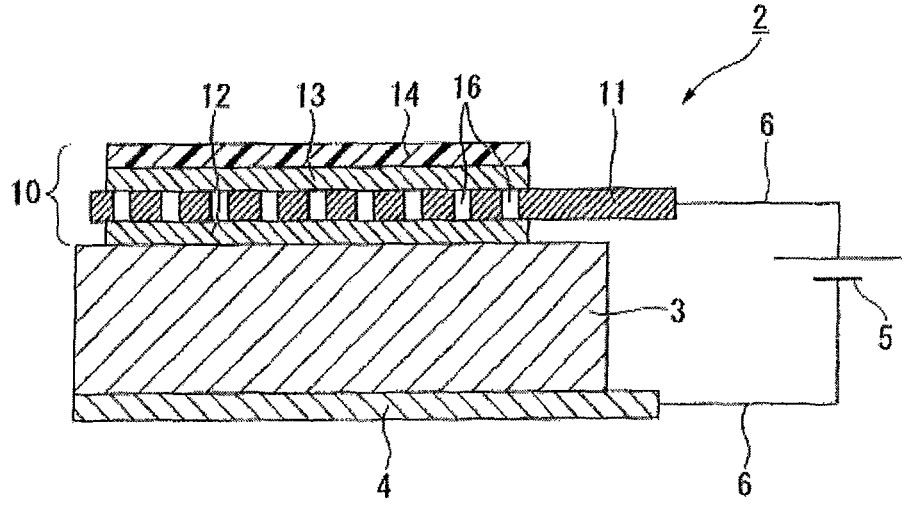
FIG. 2 is a cross sectional view schematically showing a corrosion-protecting structure of a concrete constructions using the other example of the anode according to the present invention.

Next, a description will be given of a second embodiment of the corrosion-protecting structure of the concrete constructions using the other example of the anode 10 according to the present invention with reference to FIG. 2.

A different point of the corrosion-protecting structure 2 of the concrete constructions according to the present embodiment from the first embodiment exists in a point that a second electrolyte layer 13 having such adhesive power that can be attached to the conductive layer 11 is laminated onto the surface on which the first electrolyte layer 12 is not laminated in the conductive layer 11.

The second electrolyte layer 13 carries out conversion from electron conduction into ionic conduction by an interface with the conductive layer 11. The electron conduction of positive electric charge by the electric current supplied from the external power supply 5 to the conductive layer 11 is converted into ionic conduction by both the interfaces between the first electrolyte layer 12 and the second electrolyte layer 13, and the conductive layer 11. Further, the positive electric charge converted into the ionic conduction by the interface of the second electrolyte layer 13 transmits the conductive layer 11 and efficiently moves to the concrete layer 3 together with the positive electric charge which is converted into ionic conduction by the interface of the first electrolyte layer 12.

The conductive layer 11 has many ion permeable apertures 16, through which the ion converted into the ionic conduction from the electron conduction by the second electrolyte layer 13 and having the positive electric charge.

In the case that the conductive layer 11 is a fiber conductive layer, the ion permeable aperture 16 can be formed by coating carbon material so that micro gaps between the fibers are communicated.

In the case that the conductive layer 11 is a fiber electrode, the structure is preferable, since on the surfaces a contact area between the conductive layer 11, and the first electrolyte layer 12 and the second electrolyte layer 13 becomes great by concavity and convexity, and the ion can easily move between the electrolyte layers.

In the case that the conductive layer 11 is a film conductive layer, an ion permeable conductive layer 11 is formed by coating the carbon material to both surfaces of the base of film and perforating the through hole 16.

It is preferable that a part of the first and second electrolyte layers 12 and 13 enters into the inner portion of the through hole 16 and they come into direct contact with each other. Accordingly, an inner diameter of the through hole 16 may be made smaller as long as the ion can transmit, however, is preferably set, for example, to about 0.3 to 10 mm. Further, in the case that the thickness of the conductive layer 11 is large, the diameter of the through hole 16 is preferably made large relatively.

In the case that the first and second electrolyte layers 12 and 13 are constructed by the gel electrolyte which includes electrolysis solution (electrolyte solution), the electric charge can move as long as the electrolysis solution oozing from the gel electrolyte is filled in the through hole 16. Therefore, in this case, the first electrolyte layer 12 does not necessary come into direct contact with the second electrolyte layer 13 within the through hole 16 of the conductive layer 11.

The through hole 16 can be formed in the same manner as the through hole 15. According to the punching perforation by a punch, the hole having the comparatively greater diameter can be obtained in comparison with the perforation using a heated needle or a cooled needle, and the first electrolyte layer 12 tends to come into direct contact with the second electrolyte layer 13. According to the perforation using a cooled needle, the periphery of the hole comes to an irregularly torn state and is hard to form a definite opening hole, however, in the case that the gel electrolyte is used, the ion can transmit from the torn gap.

The shape of the through hole 16 can be formed as a circular shape, an oval shape, a square shape, a rectangular shape, a polygonal shape, an indefinite shape and the other optional shapes.

Even in the case that the conductive layer 11 is the fiber conductive layer, the through hole 16 is effective in the case that the ion permeability comes short.

The second electrolyte layer 13 may be different from the first electrolyte layer 12, however, it is preferable to use the same electrolyte.

Since the second electrolyte layer 13 does not need a function of attaching to the concrete layer 3, it is possible to use an electrolyte having no adhesive power such as a structure obtained by holding the electrolyte solution in a polyacrylic salt or a polyether resin. However, the second electrolyte layer 13 having the adhesive power is preferable, since it can be laminated without using any additional adhesive bonding agent at the time of laminating with the conductive layer 11 and laminating with the protection layer 14.

In the present embodiment, the protection layer 14 is laminated on the second electrolyte layer 13, and prevents the second electrolyte layer 13 from being wetted, dried, soiled, deteriorated and broken. Accordingly, the protection layer 14 preferably covers a whole surface of the second electrolyte layer 13.

It is preferable that the protection layer 14 reflects and/or absorbs ultraviolet light and does not pass through the ultraviolet light, for protecting the second electrolyte layer 13 from being deteriorated.

Examples

A description will be given specifically of the present invention with reference to examples.

An example 1 of the anode 10 was produced according to the following procedures, and electric current change was measured at the time of applying a constant voltage by a constant voltage power supply unit. The constant voltage is applied for the reason that the electric voltage is kept 1 V which does not generate chlorine gas and oxygen gas, in order to avoid an adverse effect to results of measurement due to generation of the chlorine gas and the oxygen gas.

The conductive carbon paste in which powder graphite was dispersed into organic solvent, and blended with a binder was coated on the PPS film having a thickness of 38 μm and dried, and the conductive layer 11 having a width of 60 mm and a length of 80 mm was produced. The amount of the carbon powder coated was about 20 $g/m_2$ in dry weight. The thickness of the conductive layer 11 was 15 μm.

The conductive layer 11 obtained was perforated by heated needles from the side of PPS film surface, and a lot of through holes 15 were formed in the conductive layer 11. An ETFE film which was colored gray by blending a pigment and had a thickness of 25 μm was dry laminated in the PPS film surface of the conductive layer 11 so as to form the protection layer 14. At the dry laminating time, the adhesive bonding agent was gravure coated in a dotted pattern.

The first electrolyte layer 12 employed a hydro gel sheet ("ST-gel SR-R" manufactured by Sekisui Plastics Co., Ltd.) having a thickness of about 0.8 mm, a width of about 50 mm and a length of about 50 mm. The carbon powder surface of the conductive layer 11 was superposed and closely attached to the first electrolyte layer 12 so that a margin in the periphery of three sides of the conductive layer 11 was 5 mm and a margin in one side was 25 mm, and the example 1 of the anode 10 shown in FIG. 1 was manufactured.

The copper tape having a width of 10 mm was attached along one side in a longitudinal direction by the conductive adhesive agent to the conductive layer 11 which was exposed with a width of 25 mm in the obtained anode 10. The copper tape is an installation spot of an electric current drainage point (a positive pole connection portion of the external power supply 5), and is a power feeder member which reduces a difference of electric voltage applied at the current applying time between a far portion and a near portion in relation to the drainage point of the conductive layer 11.

The first electrolyte layer 12 of the anode 10 was adhesive bonded to the concrete layer 3 constructed by a 60 mm square shaped mortar to which an iron plate 4 having a width of 60 mm and a length of 80 mm is attached aligning three sides and which has a thickness of 20 mm. A general portland cement was used as the cement. The specification of the mortar was set such that cement, standard sand and water are 1:3:0.5 in mass ratio, according to the blend of the mortar described in JIS R 5201 "physical testing method of cement". The water cement ratio in the blend is 0.50.

The positive pole of the external power supply 5 was connected to the copper tape of the conductive layer 11 of the anode 10 by the conducting wire 6 constructed by the copper wire coated with the resin, and the negative pole of the external power supply 5 was connected to the iron plate 4 by the same conductive wire 6. The periphery of the protection layer 14 and each of the connection portions between the copper tape of the conductive layer 11 and the copper wire 6 was sealed by using a fluorocarbon resin film and an epoxy adhesive bonding agent, and the example 1 of the first embodiment of the corrosion-protecting structure 1 of the concrete constructions shown in FIG. 1 was formed.

Figure 3:
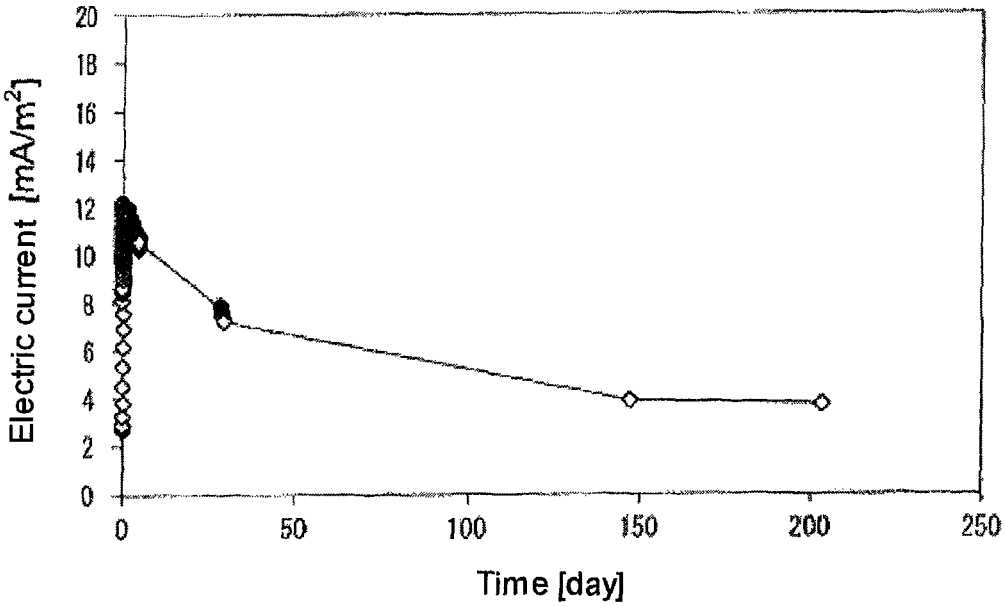
FIG. 3 is a graph showing results of a constant voltage applying test of the anode according to the present invention.

A zero-shunt ammeter (AM-02 manufactured by TOHO TECHNICAL RESEARCH CO., LTD.) was provided in a midstream of the conductive wire 6 connecting the external power supply 5 and the anode 10, and the electric voltage 1 V was applied between the conductive layer 11 and the iron plate 4 under environment of RH 85%, 60 degrees Celsius and an amount of electric current was measured. Results are shown in FIG. 3.

According to a constant voltage applying test, the electric current equal to or higher than 3 mA/m$^2$ flowed over 200 days (4800 hours) or longer. As a result, the adhesion performance of the concrete layer 3, it is known that the first electrolyte layer 12 and the conductive layer 11 against the long time current application has a practical durability. As long as the electric current equal to or higher than 3 mA/m2 flows, it is possible to achieve the corrosion protection of the reinforcing steel in which the corrosion progress is shallow, and a preliminary corrosion protection of the reinforcing steel in which the passive state membrane is formed. Therefore, the anode according to the present invention, the corrosion-protecting structure of the concrete constructions using the same and the corrosion protection method can be used in such the corrosion protection.

A comparative example 1 of the corrosion-protecting structure 1 of the concrete constructions was manufactured by employing the same structures as those of the example 1 except a structure in which a slurry is formed by inputting 20 kg of non-shrink cement (FILCON R manufactured by Sumitomo Osaka Cement Co., Ltd.) into 7.2 g of water is coated at a thickness of about 5 mm and the conductive layer 11 is adhesive bonded to the concrete layer 3, in place of the first electrolyte layer 12 used in the anode 10.

In the same manner as the constant voltage applying test of the example 1 of the corrosion-protecting structure 1 of the concrete constructions, the voltage 1 V was applied to each of the example 1 and the comparative example 1, and the amount of electric current was measured. Results are shown in FIG. 4.

Figure 4:
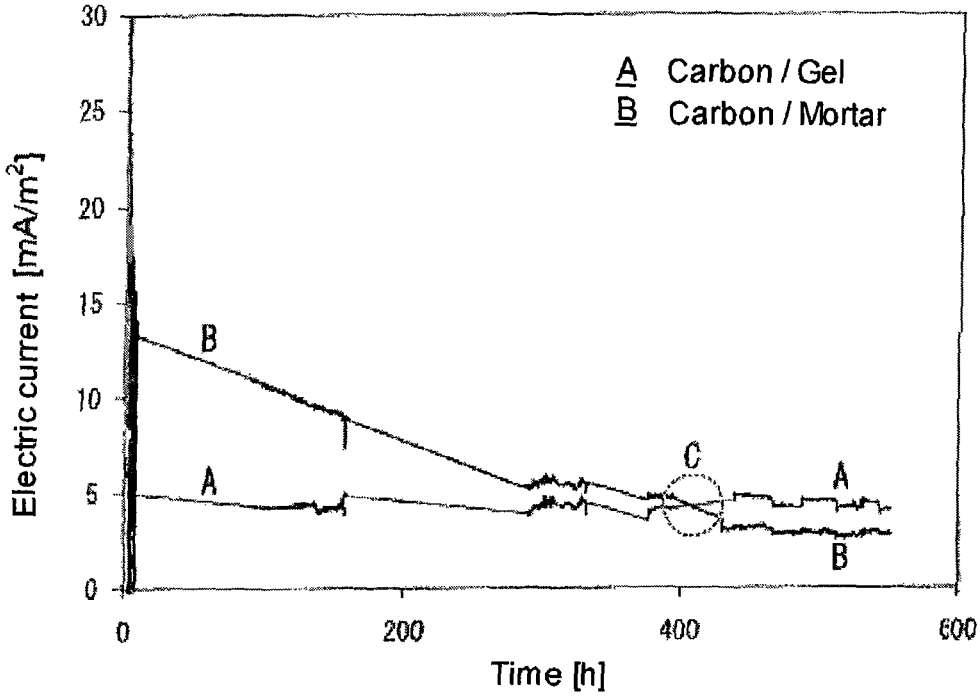
FIG. 4 is a graph showing results of the constant voltage applying test of the anode according to the present invention and an anode according to the other method.

In FIG. 4, reference symbol A is attached to the example 1 (carbon/gel), and reference symbol B is attached to the comparative example 1 (carbon/mortar).

The corrosion-protecting structure 1 according to the example 1 was smaller in its initial electric current amount in comparison with the corrosion-protecting structure according to the comparative example 1, however, was inverted for about 400 hours (shown by reference symbol C in FIG. 4), the amount of electric current was stable from the measurement start time to 500 hours, and a change of the electric current hardly appeared.

In the comparative example 1, the initial electric current amount was great, and the electric current became smaller little by little. The reason is considered due to the influence of the water content in the non-shrink cement.

Figure 5:
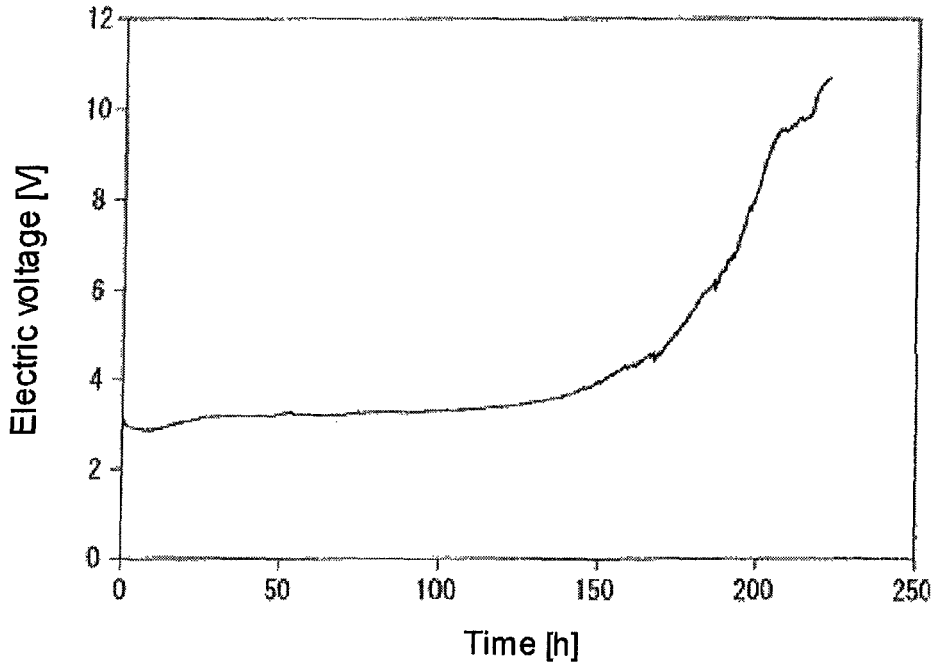
FIG. 5 is a graph showing results of a constant current applying test of an anode according to an example 1 of the present invention.

Next, on the assumption of the case that the amount of electric current allowing the demineralizing treatment and the re-alkalization is required for corrosion protecting the reinforcing steel in which the corrosion has made progress, a constant electric current of 300 mA/m$^2$ was applied to the anode 10 according to the example 1 by the constant current power supply unit, in place of the concrete layer 3 according to the example 1 manufactured by using the mortar to which a sodium chloride is further added at 10 kg/m$^3$. Results are shown in FIG. 5.

The electric current was comparatively stable at 3 to 4 V for 150 hours after starting the electric current application, however, the electric voltage thereafter rose little by little, and an electric voltage response was lost around 230 hours or longer. According to this behavior, it is assumed that the generated gas stays within the anode 10, the conductive layer 11 and the first electrolyte layer 12 are peeled, and the conductive adhesion agent of the copper tape is deteriorated.

Accordingly, an example 2 of the anode 10 was manufactured by dry laminating a PP nonwoven fabric with 30 g/m2 between the ETFE film serving as the protection layer 14 and the conductive layer 11.

Figure 6:
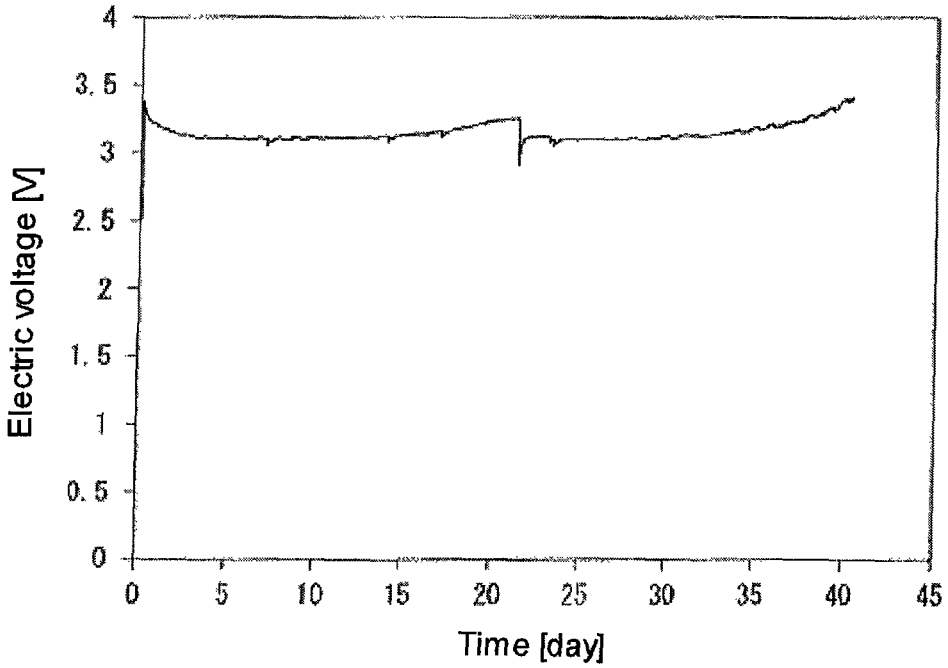
FIG. 6 is a graph showing results of the constant current applying test of an anode according to an example 2 of the present invention.

The example 2 of the corrosion-protecting structure 1 was manufactured by using the anode 10 according to the example 2 in the same manner as the example 1 of the corrosion-protecting structure 1 of the concrete constructions, and the constant electric current of 300 mA/m$^2$ was applied. Results are shown in FIG. 6.

As a result, the electric voltage was stable between 3 V and 3.5 V in 40 days, and the rising tendency of the electric voltage as shown in FIG. 5 did not appear.

The electric current equal to or more than 1 A/m2 is generally used for the demineralizing treatment and the re-alkalization, however, the demineralizing treatment and the re-alkalization make progress theoretically even by the small electric current as long as the corrosion protection effect is provided. Therefore, the anode 10 according to the present invention can be applied to the demineralizing treatment and the re-alkalization without using a protection layer having a high air permeability as the protection layer 14. According to our additional experiment, it is confirmed that the chlorine ion moves in the concrete on the basis of an elemental analysis by EPMA even in the case that the electric current of 300 mA/m$^2$ is used. Therefore, the anode according to the present invention, the corrosion-protecting structure of the concrete constructions using the same and the corrosion protection method can achieve the positive demineralizing treatment and re-alkalization, by using the protection layer having the high air permeability as the protection layer 14.

On the basis of these results of the measurements, the anode according to the present invention, it was known that the corrosion-protecting structure of the concrete constructions using the same and the corrosion protection method can be applied to the corrosion protection due to the great electric current, in relation to the reinforcing steel in which the corrosion has made progress. Therefore, according to the present invention, the deterioration is suppressed by applying the electric voltage applying such a great electric current that can allow the demineralizing treatment and the re-alkalization, as a first stage, and a conservative corrosion protection can be achieved by applying such an electric voltage that generates less gas by the electrolysis as a second stage after the passive state membrane is formed.

Further, in the case that the corrosion protection is carried out by using the great electric current, it was known that it is preferable to form the gas passage between the conductive layer 11 and the protection layer 14, by laminating the protection layer 14 on the conductive layer 11 having air permeability in the anode 10, adhesive bonding the conductive layer 11 and the protection layer 14 in the dotted pattern, and interposing an air permeable layer such as a nonwoven fabric between them.

Further, in the case of applying the corrosion protection electric current which less generates the gas and is equal to or less than 30 mA to the anode according to the present invention, the corrosion-protecting structure of the concrete constructions using the same and the corrosion protection method can achieve the corrosion protection for a long period by a simple structure in which the through hole 15 of the conductive layer 11 and the gas passage in the protection layer 14 are omitted.

As a problem at the time of carrying out the electric corrosion protection, there is a short circuit and electric corrosion phenomenon caused by a foreign body such as an iron wire at the time of piling into the concrete. In the case that the short circuit and electric corrosion occurs, soil and/or gas is generated at the time of an electromagnetic corrosion protection. Therefore, it is necessary to remove the foreign body in the concrete at the time of piling.

Since the anode according to the present invention employs the electrolyte layer in the contact point with the concrete, the anode does not come into direct contact with the foreign body. Therefore, since it is thought that the anode according to the present invention can scale back the influence of the short circuit and the electric corrosion, the anode 10 and a test piece were manufactured and an experiment was carried out.

An example 3 of the anode 10 was manufactured by employing the same structures as those of the example 1 of the anode 10 except a structure in which the conductive layer 11 having a width of 110 mm and a length of 130 mm is manufactured, and a hydro gel sheet having a width of 100 mm and a length of 100 mm is attached.

Test pieces were formed as a square shape in which end surfaces are 100 mm vertically and horizontally, and were constructed as a concrete rectangular column having a length of 600 mm. At the time of manufacturing the test pieces, a standard test piece was set by burying a reinforcing steel having a diameter of 16 mm so that an end portion is exposed from a center of both the end surfaces of the concrete rectangular column. The standard test piece was set such that 357 mix sand and 10 kg/m3 salt were mixed in a common cement, and a water cement ration was set to 50%. Further, an iron wire having a diameter of 3 mm was buried in the center in a longitudinal direction of one surface of the standard test piece so that a part thereof is exposed. At the time of burying the iron wire in the test piece, a short circuit test piece was formed by arranging three iron wires in parallel so as to be winded around the reinforcing steel and buried. And a electric corrosion test piece was formed by arranging three iron wires in parallel to one surface of the test piece along the reinforcing steel so as to be buried.

The example 3 of the corrosion-protecting structure was formed by attaching the anode 10 according to the example 3 to the center in the longitudinal direction of the surface of the standard test piece. Further, an example 4 and an example 5 of the corrosion-protecting structure were formed by attaching the anode 10 according to the example 3 onto three iron wires which are exposed to the surfaces of the short circuit test piece and the electric corrosion test piece.

On the other hand, comparative examples 2 to 4 of the corrosion-protecting structure were formed by adhesive bonding the anode constructed by a titanium mesh (width 100 mm and length 100 mm) obtained by platinum plating a narrow wire having a diameter of 1 mm and formed as a rhombic net shape of 22 mm×45 mm in place of the anode 10 according to the examples 3 to 5 by a mortar having a thickness of 10 mm.

Further, the constant electric current of 26 mA/$m^2$ was applied to each of the examples 3 to 5 and the comparative examples 2 to 4 of the corrosion-protecting structure, and a change amount of the electric voltage applied to the corrosion protection circuit and the reinforcing steel electric potential in relation to the natural electric potential was measured per one hour by using a data logger. At the time of measuring, an attached type reference electrode of AgCl was attached to the surface of the test piece in which the anode does not exist. An experimental temperature was fixed to 20° C., the examples 3 to 5 were measured for 120 days, and the comparative examples 2 to 4 were measured for 50 days.

Almost the same behavior exhibits in the electric voltages applied in the example 3 which employs the standard test piece, and the example 5 which employs the electric corrosion test piece. The electric voltages applied to the example 3 and the example 5 were 1.25 V at the beginning of the corrosion protection, thereafter rose, and became stable at 1.75 V from about 20 days.

On the other hand, electric voltage applied to the example 4 which employs the short circuit test piece was 1.1 V at the beginning of the corrosion protection, rose according to an approximately constant incline, and became stable at about 1.7 V from about 70 days.

In other words, the electric voltage equal to or lower than 2 V was applied to each of the examples 3 to 5, and the examples 3 to 5 had such a tendency that converts into a fixed electric voltage.

A longer time was required until the electric voltage of the example 4 of the short circuit test piece was fixed, in comparison with the example 3 using the standard test piece. It was assumed that the electric current was applied on the basis of the ionic conduction of the hydro gel, the iron wire was corrosion protected, the passive state membrane was formed in the contact portion between the hydro gel and the iron wire and the electric current is hard to be applied. As a result, it was assumed that the electric current was applied to the other portions than the contact portion little by little.

On the other hand, the electric voltage applied to the comparative example 2 employing the standard test piece was 2 V at the beginning of the corrosion protection, thereafter rose with an approximately fixed incline, reached 4 V for 50 days, and was rising further.

The electric voltage applied to the comparative example 3 employing the short circuit test piece was 2.5 V at the beginning of the corrosion protection, thereafter rose with an approximately fixed incline, reached 3.8 V for 50 days, and was rising further. In the comparative example 3, since the reinforcing steel and the titanium mesh are short circuited by the iron wire, it was expected that the electric current was applied with the low electric voltage, however, twice or higher electric voltage was required actually in comparison with the example 3. It was assumed that since the titanium mesh was adhesive bonded by the mortar, the contact resistance was high and the short circuit electric current was smaller than the expected one, on the basis of small difference from the comparative example 2.

The electric voltage applied to the comparative example 4 employing the electric corrosion test piece was 1.3 V at the beginning of the corrosion protection, thereafter rose with an approximately fixed incline, reached 1.9 V for 50 days, and was rising further.

The change amount of the reinforcing steel electric potential in relation to the natural electric potential was different in each of the examples 3 to 5, however, rose with an approximately fixed similar incline, and was rising further. The change amount of the electric potential at the beginning of the corrosion protection was 200 mV in the example 3 employing the standard test piece, 175 mV in the example 4 employing the short circuit test piece, and 280 mV in the example 5 employing the electric corrosion test piece. The change amount of the electric potential on 120th day was 280 mV in the example 3, 225 mV in the example 4, and 350 mV in the example 5.

On the other hand, the comparative example 2 employing the standard test piece was 300 mV at the beginning of the corrosion protection, rose to 320 mV for 5 days, and thereafter was approximately fixed.

The comparative example 3 employing the short circuit test piece was 125 mV at the beginning of the corrosion protection, and rose to 160 mV for one day. Further, it underwent a transition at a fixed value from 9 days to 15 days, thereafter downed little by little, and was fixed approximately at 150 mV for 45 days.

The comparative example 4 employing the electric corrosion test piece was 200 mV at the beginning of the corrosion protection, and rose to 250 mV for one day. Thereafter, it rose with an approximately fixed incline, reached 300 mV for 50 days, and was rising further.

From these matters, in the examples 3 to 5, the change amount of the reinforcing steel electric potential greatly goes beyond 100 mV in any of them, and the corrosion protection can be achieved. Further, in the case that the fixed corrosion protection electric current is applied, it was known that the lower electric voltage was applied in comparison with the comparative examples 2 to 4.

Further, the difference of the change amount in the reinforcing steel electric potential of the comparative example 3 was 175 mV which was 58% reduction, at the beginning of the corrosion protection, and 170 mV which was 53% reduction, for 50 days, that is, was less than a half, the comparative example 3 employing the short circuit test piece in relation to the comparative example 2 employing the standard test piece. This was assumed that a part of the electric current flowed by the electronic conduction due to the short circuit.

On the other hand, the difference of the change amount in the reinforcing steel electric potential of the example 4 was 25 mV which was 13% reduction, at the beginning of the corrosion protection, and 55 mV which was 20% reduction, for 120 days, that is, was smaller than the comparative example 2, the comparative example 4 employing the short circuit test piece in relation to the example 3 employing the standard test piece. Further, the examples 3 to 5 showed a tendency that the electric voltage applied to the corrosion protection circuit is converged into a fixed value. Therefore, it was known that the example 3 employing the short circuit test piece could achieve a stable corrosion protection without being applied the short circuit electric current.

Further, it was assumed that the applied electric voltage is lower in the comparative example 4 employing the electric corrosion test piece in comparison with the comparative example 2 employing the standard test piece, since the iron wire served as the anode, and the area coming into contact with the concrete was increased. Therefore, it was assumed that the iron wire was strongly exposed to the electric corrosion.

On the other hand, the electric voltage shows almost the same behavior in the example 4 employing the electric corrosion test piece and the example 5 employing the standard test piece. Therefore, it was known that the example 4 employing the electric corrosion test piece can achieve a stable corrosion protection without being affected by the electric corrosion portion.

Further, since the corrosion-protecting structure according to the present invention covers the surface of the concrete with the anode, no problem is generated even if the electric corrosion is generated, and the rust soil appears on the surface of the concrete.

The description is given above of the present invention with reference to the accompanying drawings, on the basis of the preferable embodiments, however, the present invention is not limited to these embodiments. In these embodiments, the electric feed member constructed by the copper tape is attached along one side in the longitudinal direction of the conductive layer, however, in the case of employing the conductive layer having a small surface resistance such as a metal foil, a metal ribbon, a woven cloth of a metal fiber, a metal mesh like a expand metal, and the sheet made of the carbon material having a conductive property, the electric feed member may be omitted. Further, in the case of employing the carbon coated sheet having a great surface resistance, the electric feed member may be provided in two opposed sides in the longitudinal direction of the conductive layer, two sides in the longitudinal direction and their intermediate, or four sides of the conductive layer. Further, the electric feed member may be constructed by a thread in place of the tape. The material of the electric feed member may be constructed by titanium or stainless steel.

What is claimed is:

1. An anode comprising:

a conductive layer formed as a sheet, said conductive layer being formed with a multiplicity of gas permeable apertures in the form of through-holes; and a first electrolyte layer formed as a sheet and having adhesive power possible to attach to said conductive layer and a surface layer of an object to be protected from corrosion, wherein the first electrolyte layer is attached to one surface of the conductive layer, wherein the conductive layer is made of carbon powder or graphite sheet material, wherein the gas permeable apertures are linear through-holes having a diameter of 0.1 to 1 mm.

2. The anode according to claim 1, wherein the conductive layer is supported by a base of fiber or a base of film.

3. The anode according to claim 1, wherein a second electrolyte layer is formed into a sheet and has adhesive power to enable the second electrolyte layer to be attached to the other surface of the conductive layer opposite the first electrolyte layer.

4. The anode according to claim 1, wherein the outside of the conductive layer is covered with a protection layer.

5. The anode according to claim 3, wherein the outside of the second electrolyte layer is covered with a protection layer.

6. A corrosion protection structure for concrete constructions, wherein the anode according to claim 1 is attached to a surface of concrete constructions by using the first electrolyte layer, the conductive layer of the anode is connected to a positive electrode of an external power supply, and a negative electrode of the external power supply is connected to the object to be protected from corrosion.

7. The anode according to claim 2, wherein the conductive layer is supported by a base of fiber made of a polymeric composition.

8. The anode according to claim 7, wherein the base of fiber is cross-linked.

9. An anode comprising:

a conductive layer formed as a sheet, said conductive layer being formed with a multiplicity of gas permeable apertures in the form of through-holes; and a first electrolyte layer formed as a sheet and having adhesive power possible to attach to said conductive layer and a surface layer of an object to be protected from corrosion, wherein:

the first electrolyte layer is attached to one surface of the conductive layer;

the conductive layer includes carbon powder;

the carbon powder is applied to a base of polymeric fiber, wherein the gas permeable apertures are linear through-holes having a diameter of 0.1 to 1 mm.

10. The anode according to claim 9, wherein the base of polymeric fiber is cross-linked.

* * * * *